US005920941A

United States Patent [19]

Iannotta

[11] Patent Number: 5,920,941

[45] Date of Patent: Jul. 13, 1999

[54] DENTURE BRUSH

[75] Inventor: Charles Iannotta, Concord, Calif.

[73] Assignee: Charlotte Copeland, Walnut Creek, Calif.

[21] Appl. No.: 08/956,374

[22] Filed: Oct. 23, 1997

[51] Int. Cl.[6] ..... A46B 9/04

[52] U.S. Cl. ..... 15/106; 15/167.1; D4/106

[58] Field of Search ..... 15/106, 167.1; D4/104–106, 119, 120, 134, 138

[56] References Cited

U.S. PATENT DOCUMENTS

| | | | |
|---|---|---|---|
| D. 130,437 | 11/1941 | Patterson | D4/106 |
| D. 363,820 | 11/1995 | Winge | D4/106 |
| D. 377,867 | 2/1997 | Berghash | D4/105 |
| 2,127,794 | 8/1938 | Wastman | 15/106 |
| 4,670,931 | 6/1987 | Abbassi | 15/106 |
| 5,305,489 | 4/1994 | Lage | 15/167.1 |
| 5,465,449 | 11/1995 | Lewkowicz . | |

*Primary Examiner*—Terrence R. Till
*Attorney, Agent, or Firm*—Theodore J. Bielen, Jr.

[57] ABSTRACT

A denture brush utilizing a base having a support and a handle connected to the support. The support is provided with a first surface and an opposite second surface. A first group of bristles is fixed relative to the first surface and extend generally orthogonally outwardly from the first surface. A second group of bristles is fixed relative to the second surface and extends outwardly in a direction opposite to the first group of bristles. A gripping surface is also located on the handle adjacent the second set of bristles on the second surface of the support.

12 Claims, 2 Drawing Sheets

FIG-4
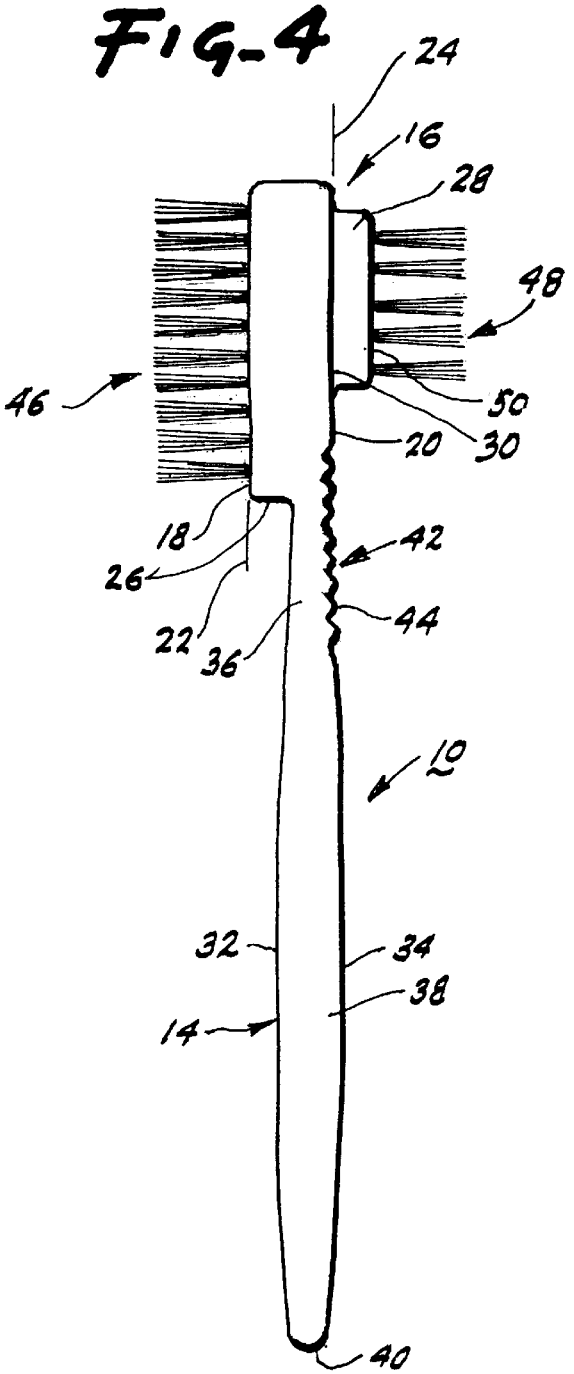
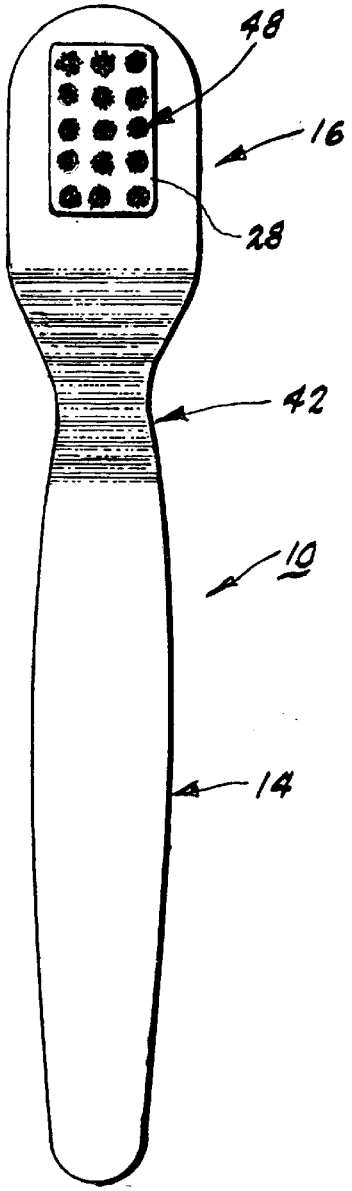
FIG-5

DENTURE BRUSH

BACKGROUND OF THE INVENTION

The present invention relates to a novel denture brush structure.

Dentures require constant cleaning to maintain their integrity and appearance. In the past, persons have used tooth brush type structures to clean dentures. However, it has been found that dentures possess a special problem in that a multitude of surfaces must be cleaned that are not encountered in the normal cleansing of natural teeth.

In the past, many brushes have been proposed to clean teeth utilizing a plurality of sets of bristles. For example, U.S. Pat. Nos. 2,123,407 and 5,331,704 show tooth brushes that include sets of bristles on opposite surfaces or different flanges that extend from the head portion of the brush.

U.S. Pat. Nos. 2,190,277, 2,236,034, and 5,465,449 show denture brushes in which bristles are extended out from the head portion of a brush in various directions and at various angles.

Although brushes of various configurations have been proposed to clean dentures, none of the prior art brushes permits the user to apply firm pressure to the brush by use of the thumb in order to clean the outer surface of the dentures as well as the inside portion of the dentures having a groove for carrying adhesive.

SUMMARY OF THE INVENTION

In accordance with the present invention a novel and useful brush for cleaning dentures is herein provided.

The brush of the present invention utilizes a base which is divided into a handle which terminates in a support. The support may be larger than the handle and possess a first surface and an opposite second surface. In certain cases, an element may be connected to the second surface of the support or formed integrally with the second surface of the support in order to provide an extension outwardly from the remainder of the support. In many cases, the first surface and the second surface of the support may be located outwardly relative to the opposite surfaces of the handle of the base. Wall portions may be formed in the support to provide such outward extension of the elements and the first surface of the support relative to the handle.

A first group of bristles is fixed relative to the first surface and may extend outwardly directly from the first surface. The first group of bristles are constructed with a certain transverse dimension which is particularly useful for cleaning the outer surfaces and artificial teeth of the denture.

A second group of bristles may be fixed directly or relative to the second surface and extend outwardly from the second surface. The second group of bristles may also be fixed to the element which is connected to the support portion of the base. In either case, the second group of bristles have a certain transverse dimension which is less than the transverse dimension of the first group of bristles. The second group of bristles is particularly useful for cleaning interstices such as the groove within the set of dentures that holds adhesive.

A gripping surface is also located at the handle of the brush stricture of the present invention, adjacent to the second set of bristles. The gripping surface may include a portion which is roughened relative to the second surface of the base. Thus, the structure formed by the gripping surface in relation to the first and second group of bristles permits the thumb of the user to press on the roughened surface when the first set of bristles is being used on the outer surface of the dentures. Likewise, the thumb may press on the smooth portion of the handle such that the index finger is on the roughened portion when the second set of bristles is used to clean the inner groove of the dentures. The wall portions adjacent the first and second surfaces of the support serve as stops for portions of the hand either group of bristles is employed.

It may be apparent that a novel and useful denture brush structure has been described. It is therefore an object of the present invention to provide a denture brush structure which allows the user to easily and thoroughly clean a set of dentures.

Another object of the present invention is to provide a denture brush structure in which two distinct groups of bristles are employed and the brush structure permits the user to exert pressure on the dentures with the thumb portion of the hand in either of two positions.

Another object of the present invention is to provide a denture brush structure which is simple and economical to manufacture.

Yet another object of the present invention is to provide a denture brush structure that is durable after repeated usages.

The invention possesses other objects and advantages especially as concerns particular characteristics and features thereof which will become apparent as the specification continues.

BRIEF DESCRIPTION OF THE DRAWINGS

FIG. 4 is a side elevational view of the brush structure of the present invention.

FIG. 5 is a top plan view of the brush structure of the present invention

Figure 2:
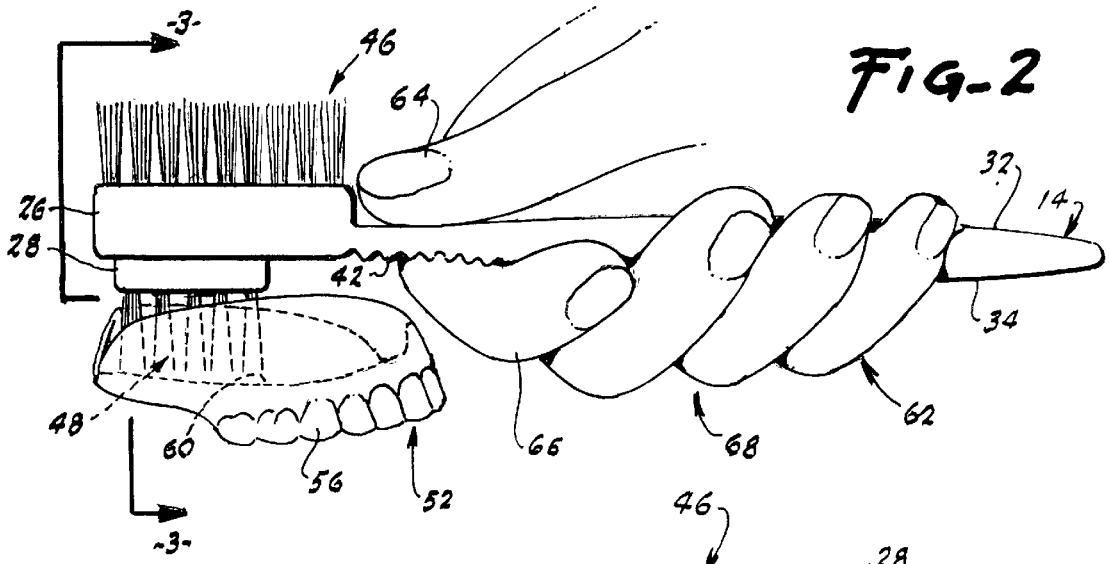
FIG. 2 is a side elevational view of the brush structure of the present invention in which the second set of bristles is depicted as being used on the inner surfaces of a pair of dentures.

For a better understanding of the invention references made to the following detailed description of the preferred embodiments thereof which should be taken in conjunction with the herein above described drawings.

DETAILED DESCRIPTION OF THE PREFERRED EMBODIMENTS

Various aspects of the present invention will evolve from the following detailed description of the preferred embodiments which should be viewed with the prior described drawings.

The invention as a whole is shown in the drawings by reference character 10. Brush structure 10 is particularly suited for use with dentures 12 depicted in FIGS. 1 and 2. With reference to FIGS. 3 and 4, it may be observed that brush structure 10 includes, as one of its elements, a handle portion 14 and support portion 16. Support 16 includes a first surface 18 and a second opposite surface 20. In essence, first surface 18 lies within a plane 22 while second surface 20 lies in a plane 24. Planes 22 and 24 are generally parallel relative to one another. Support 16 includes a wall portion 26 which permits surface 18 to lie outwardly from handle 14. An element 28 is also fixed to support 16. Element 28 is formed into a substantially rectangular solid body. It should be understood, that element 28 may be formed integrally with support 16. With reference to FIG. 3 it may be seen that element 28 does not completely cover surface 20 of support 16, since it is shorter and narrower at than surface 30.

Handle 14 also includes a first surface 32 and a generally opposite surface 34. Handle 14 is formed integrally with support 16 and extends from a relatively narrow neck portion 36 to an enlarged middle section 38. Enlarged middle section 38 tapers to a narrower tip 40. Gripping surface 42 is located at handle 14 and spans second surface 20 of support 16 and second surface 34 of handle 14. Gripping surface 42 includes a roughened portion 44, in the form of ridges in the embodiment depicted in FIG. 3. It should be realized, that other configurations of gripping surface 42 may be employed, such as indents, reticulations, overlays having roughened surfaces, and the like. In the embodiment depicted in the drawings, second surface 44 of handle 14 is generally contiguous with second surface 20 of support 16.

A first group of bristles 46 is fixed relative to first surface 18 in a conventional manner. That is to say, bristles 46 may be connected to surface 18 with a mastic, imbedded within support 16 through a molding process, and the like. Relative to plane 22, bristles 46 generally extend outwardly from surface 18 in an orthogonal manner. Needless to say, first group of bristles 46 are formed into tufts that flare slightly from base to tip.

The second group of bristles 48 are fixed relative to second surface 20 and extend outwardly therefrom. Second group of bristles 48 are depicted in the embodiment of FIG. 4 as being fixed to element 28 and emerged from support 16 at surface 50 of element 28. Second group of bristles 48 are fixed to element 28 in the same manner as described hereinabove with respect to first group of bristles 46. Again, FIGS. 4 and 5 depict the position and orientation of first and second groups of bristles 46 and 48, respectively. Turning now to FIG. 3, it may be seen that the transverse dimension, D1, of first group of bristles 46 is greater than the transverse dimension, D2, of second group of bristles 48.

Figure 3:
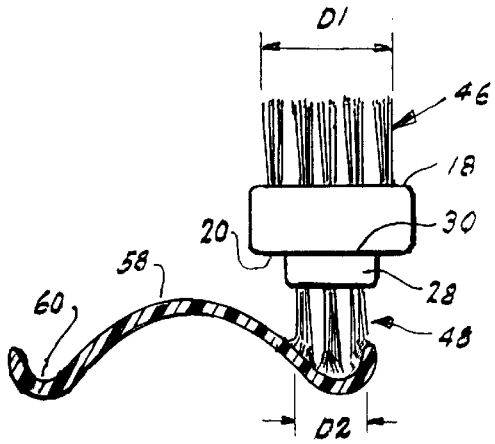
FIG. 3 is a sectional view taken along line 3—3 of FIG. 2.
Figure 1:
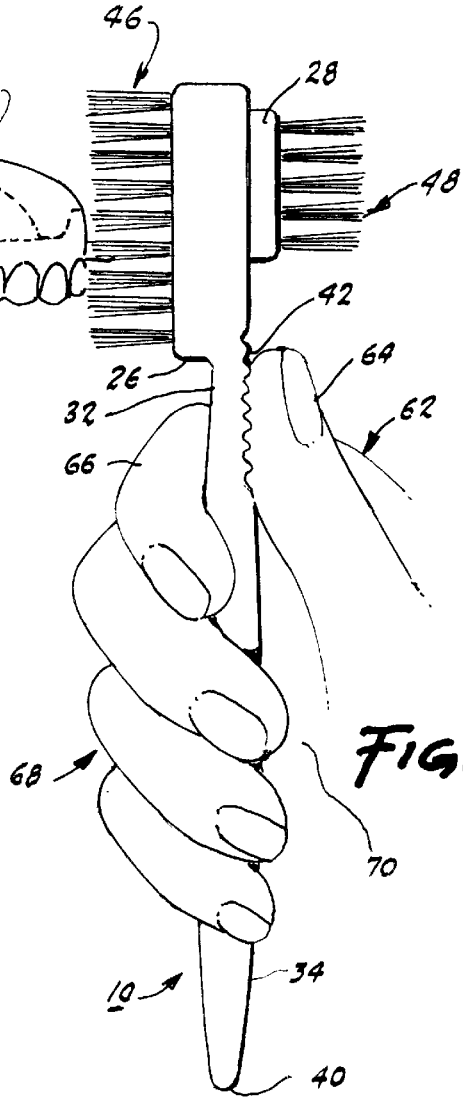
FIG. 1 is a side elevational view of the brush structure of the present invention in which the first group of bristles are illustrated as cleaning the outer surfaces of a set of dentures.

In operation, FIGS. 1–3 depict a set of typical dentures 52. Dentures 52 have an outer portion 54 and artificial teeth 56. In addition, the inner portion 58 of dentures 52 includes a groove 60 which is generally used to hold adhesive, permitting dentures 52 to be positioned in the user's mouth along the jaw line. Specifically, with reference to FIG. 2 it may be apparent that the user's hand 62 is shown such that when first group of bristles 46 is employed to clean the outer portion of dentures 52 and the outside and inside of artificial teeth 56, thumb 64 firmly rests upon gripping surface 42. Index finger 66 contacts first surface 32 of handle 14. Wall 26 serves as a stop for index finger 66 and also prevents the contact of index finger 66 with the first group of bristles 46 during the employment of the same. Remaining fingers 68 encompass, generally, the large middle portion 38 and tip 40 of handle 14. With respect to FIGS. 1 and 3, it is illustrated that the user is employing second group of bristles 48 to clean groove 60 of dentures 52. Thumb 64 rests on first surface 32 of handle wall portion 26 of support 16 serves as the stop for thumb 64. Similarly, wall 64 acts to prevent pressure being exerted by thumb 64 against second group of bristles 46. Index finger 66 contacts gripping surface 42. Fingers 68 and palm 70, again, wrap around handle 14 as shown in FIG. 2. The position of second group of bristles 48 and element 28 allows the user to clean groove 60 of dentures 52 without hand 62 contacting dentures 52. Gripping surface 42 and wall 26 aids in this endeavor in preventing the slippage of hand 62 toward second group of bristles 48 during the cleaning of groove 60. Thus, denture brush 10 serves to clean various portions of dentures 52 by simply reversing the orientation of the same in order to employ either first group of bristles 46 or second group of bristles 48. Of course the cleaning process employs denture cream with either group of bristles.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A denture brush, comprising;

a. a support and a handle having an end portion connected to said support, said support including a first surface and an opposite second surface;

b. a first group of bristles fixed relative to said support first surface and extending outwardly therefrom, said first group of bristles having a certain transverse dimension;

c. a second group of bristles fixed relative to said support second surface and extending outwardly therefrom, said second group of bristles having a certain transverse dimension less than said transverse dimension of said first group of bristles; and d. a gripping surface located at said handle end portion connected to said support, immediately adjacent said second set of bristles, said gripping surface including a portion roughened relative to said second surface of said base.

2. The denture brush of claim 1 in which said first set of bristles extend outwardly directly from said support.

3. The denture brush of claim 2 which additionally comprises an element fixed to said second surface of said support said second set of bristles being fixed to said element and extending outwardly therefrom.

4. The denture brush of claim 1 in which said first surface lies essentially in a first plane and said second surface lies essentially in a second plane, said first plane positioned substantially parallel to said second plane, said first set of bristles orthogonally fixed to said first surface and said second set of bristles fixed to said second surface.

5. The denture brush of claim 4 which additionally comprises an element fixed to said second surface of said support said second set of bristles being fixed to said element and extending outwardly therefrom.

6. The denture brush of claim 5 in which said element includes a wall portion extending outwardly from said second surface of said support, said wall portion separating said second set of bristles from said second surface.

7. A denture brush, comprising;

a. a support and a handle connected to said support, said support including a first surface and an opposite second surface, said handle including a first surface and an opposite second surface, said support including a wall portion, said first surface of said support being transversely spaced from said first surface of said handle by said wall portions b. a first group of bristles fixed relative to said support first surface and extending outwardly therefrom, said first group of bristles having a certain transverse dimension;

c. a second group of bristles fixed relative to said support second surface and extending outwardly therefrom, said second group of bristles having a certain transverse dimension less than said transverse dimension of said first group of bristles; and d. a gripping surface located at said handle, adjacent said second set of bristles, said gripping surface including a portion roughened relative to said second surface of said base.

8. The denture brush of claim 7 which additionally comprises an element fixed to said second surface of said support said second set of bristles being fixed to said element and extending outwardly therefrom.

9. The denture brush of claim 8 in which said element includes a wall portion extending outwardly from said second surface of said support, said wall portion separating said second set of bristles from said second surface.

10. The denture brush of claim 9 in which said first surface lies essentially in a first plane and said second surface lies essentially in a second plane, said first plane positioned substantially parallel to said second plane, said first set of bristles orthogonally fixed to said first surface and said second set of bristles fixed to said second surface.

11. The denture brush of claim 10 in which said second group of bristles are spaced from said gripping surface at said second surface of said handle.

12. The denture brush of claim 11 in which said gripping surface is located at the second surfaces of said support and said handle.

* * * * *